US011566520B2

(12) United States Patent
Brown et al.

(10) Patent No.: US 11,566,520 B2
(45) Date of Patent: Jan. 31, 2023

(54) SENSOR NIPPLE AND PORT FOR DOWNHOLE PRODUCTION TUBING

(71) Applicant: HALLIBURTON ENERGY SERVICES, Houston, TX (US)

(72) Inventors: Clint Adam Brown, Port Jefferson, NY (US); Suzi Marie Marcuccio, Conroe, TX (US); Michael Linley Fripp, Carrollton, TX (US); Thomas Jules Frosell, Irving, TX (US)

(73) Assignee: HALLIBURTON ENERGY SERVICES, Houston, TX (US)

( * ) Notice: Subject to any disclaimer, the term of this patent is extended or adjusted under 35 U.S.C. 154(b) by 683 days.

(21) Appl. No.: 16/484,743

(22) PCT Filed: Feb. 8, 2018

(86) PCT No.: PCT/US2018/017441

§ 371 (c)(1),
(2) Date: Aug. 8, 2019

(87) PCT Pub. No.: WO2018/160340

PCT Pub. Date: Sep. 7, 2018

(65) Prior Publication Data

US 2020/0011172 A1 Jan. 9, 2020

Related U.S. Application Data

(60) Provisional application No. 62/467,033, filed on Mar. 3, 2017.

(51) Int. Cl.
*E21B 49/08* (2006.01)
*E21B 17/02* (2006.01)
(Continued)

(52) U.S. Cl.
CPC ..... *E21B 49/087* (2013.01); *E21B 17/026* (2013.01); *E21B 23/02* (2013.01); *E21B 43/14* (2013.01)

(58) Field of Classification Search
CPC ..... E21B 49/087; E21B 17/026; E21B 23/02; E21B 43/14
(Continued)

(56) References Cited

U.S. PATENT DOCUMENTS 5,829,520 A * 11/1998 Johnson ..... E21B 43/11 166/250.01
8,960,313 B2 * 2/2015 Dyer ..... E21B 33/127 166/387
(Continued)

OTHER PUBLICATIONS

International Search Report and Written Opinion; PCT Application No. PCT/US2018/017441; dated Feb. 2, 2018.

*Primary Examiner* — Matthew R Buck
*Assistant Examiner* — Patrick F Lambe
(74) *Attorney, Agent, or Firm* — Polsinelli PC

(57) ABSTRACT

A tubular string formed by one or more tubulars with a central flow passage for an internal fluid therethrough and an external surface. The tubular having a wall thickness defined between external surface and the central flow passage and at least one sensor port disposed along a longitudinal length of the tubular. At least one sensor includes a main body and=nipple extending from the main body and inserted into the sensor port of the tubular. The nipple extends through the wall thickness sufficient to detect a property of an internal fluid within the central flow passage.

38 Claims, 4 Drawing Sheets

(51) Int. Cl.
*E21B 23/02* (2006.01)
*E21B 43/14* (2006.01)

(58) Field of Classification Search
USPC ..... 73/152.28
See application file for complete search history.

(56) References Cited

U.S. PATENT DOCUMENTS

| | | | | |
|---|---|---|---|---|
| 9,057,252 | B2 * | 6/2015 | Bell | E21B 49/086 |
| 9,523,270 | B2 * | 12/2016 | Fripp | E21B 47/017 |
| 2004/0154390 | A1 * | 8/2004 | Baustad | E21B 47/06 73/152.55 |
| 2007/0012453 | A1 | 1/2007 | Coronado et al. | |
| 2011/0232921 | A1 * | 9/2011 | Hopmann | E21B 17/026 166/385 |
| 2016/0201448 | A1 | 7/2016 | Patel | |
| 2016/0273286 | A1 | 9/2016 | Britton et al. | |
| 2016/0290133 | A1 * | 10/2016 | Xia | G01V 1/48 |

* cited by examiner

SENSOR NIPPLE AND PORT FOR DOWNHOLE PRODUCTION TUBING

CROSS-REFERENCE TO RELATED APPLICATIONS

This application is a national stage entry of PCT/US2018/017441 filed Feb. 8, 2018, which claims the benefit of U.S. Provisional Application No. 62/467,033 filed Mar. 3, 2017, and each of the aforementioned applications are expressly incorporated herein in their entirety.

FIELD

The present technology is directed to downhole sensors for measuring fluid properties. In particular, the present technology involves sensors provided with tubing, such as production tubing, for determining various downhole properties.

BACKGROUND

Wellbore completion involves preparing a well for hydrocarbon production after drilling operations have been conducted. During this phase production tubing may be provided downhole for injecting various fluids and/or withdrawing hydrocarbon. Stimulation processes may have also been conducted including creating fractures in the formation. During these completion processes packers may be provided to isolate various zones along the length of the tubing and wellbore. These zones may isolate particular areas to facilitate production of hydrocarbon from the fractured portions of the formation.

During the completion phases, it is desirable to measure properties of the fluid, formation, or tubing downhole. Accordingly sensors may be provided downhole at various points of the tubing to collect data for processing.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

The present disclosure provides for porting one or more sensors (or gauges) within a sensor array to a production tubing string at any location by piercing, drilling, porting, burning, etc., which may be conducted quickly and at low cost. A sensor nipple may be incorporated or coupled with one or more sensors to provide for flexibility in the system such that the placement need not be exact, but may be employed wherever it may fall during a tubular deployment process. The sensor nipple may be formed integrally as part of the sensor or may be coupled or provided as part of a cover. The nipple can allow the sensor and corresponding sensor port in the tubing string to be implemented without exact or rigid placement positioning during the complete process (or other processes involving the use of downhole tubing).

Figure 1:
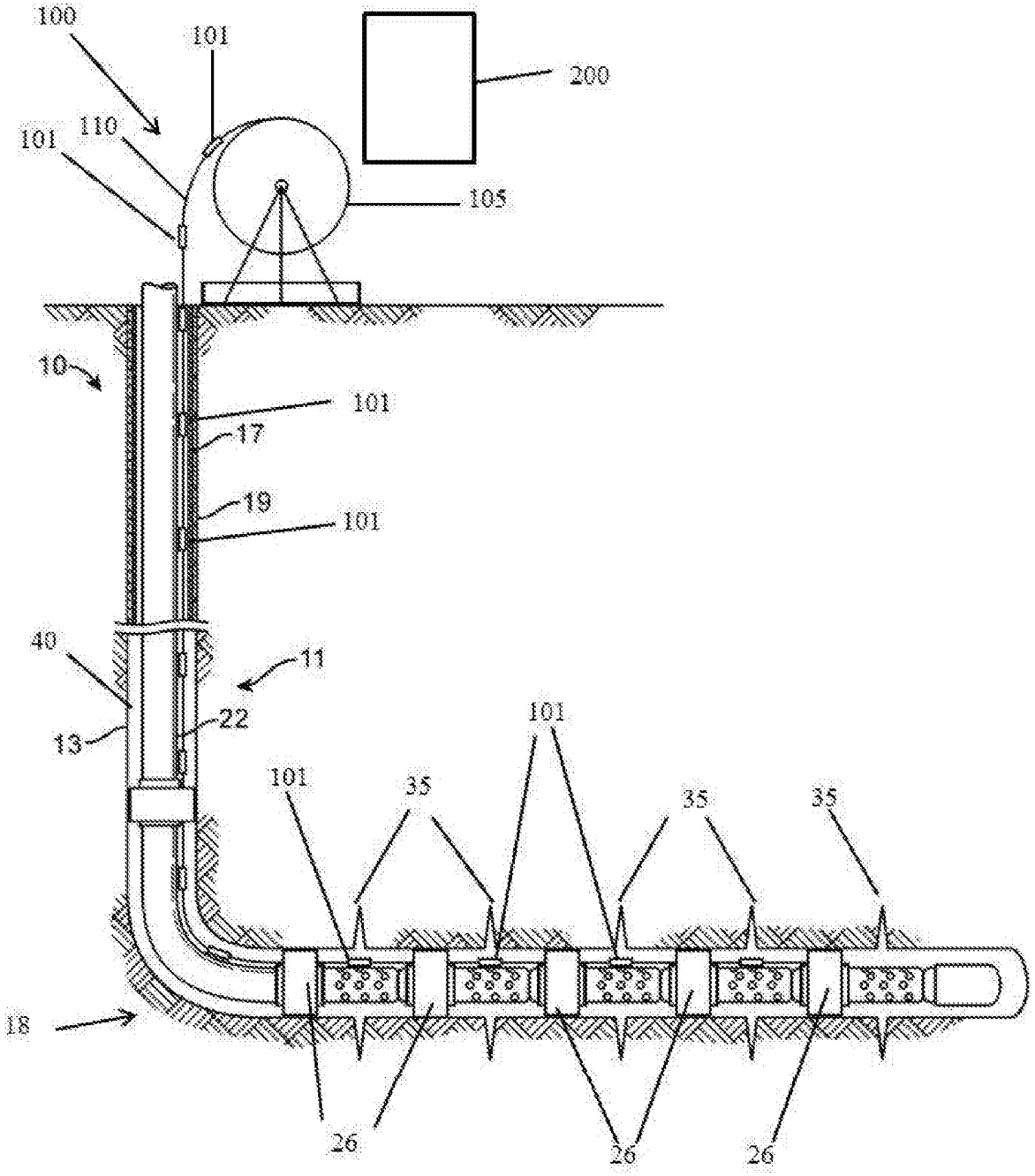
FIG. 1 is a schematic diagram of a tubular string provided in a wellbore for completion processes.

FIG. 1 is a schematic diagram depicting an environment in which the present disclosure may be implemented. As illustrated, the environment includes a completion 10. Although a completion is illustrated in FIG. 1, the present disclosure may be implemented in a well with no production, flow, or injection, and may operate equally as well without packers, isolated zones, as well as in alternative phases of a well which are not under completion. With respect to the embodiment shown in FIG. 1, the completion 10 includes a tubular string 22 for use in completion and stimulation of formation, and an annulus 40. The terms stimulation and injection, as used herein, can include fracking, acidizing, hydraulic work, and other work-overs. The tubular string 22 may be made up of a number of individual tubulars, also referred to as sections or joints. The sections can include multiple such assemblies as well as blank tubing, perforated tubing, shrouds, joints, or any other sections as are known in the industry. Each of the tubulars of the tubular string 22 may have a central flow passage an internal fluid and an external surface. The term "tubular" may be defined as one or more types of connected tubulars as known in the art, and can include, but is not limited to, drill pipe, landing string, tubing, production tubing, jointed tubing, coiled tubing, casings, liners, or tools with a flow passage or other tubular structure, combinations thereof, or the like.

A wellbore 13 extends through various earth strata. Wellbore 13 has a substantially vertical section 11, the upper portion of which has installed therein casing 17 held in place by cement 19. Wellbore 13 also has a substantially deviated section 18, shown as substantially horizontal, extending through a hydrocarbon bearing portion of a subterranean formation 20. As illustrated, substantially horizontal section 18 of wellbore 13 is open hole, such that there is not a casing. It is understood that within the present disclosure, the wellbore may be cased or open, vertical, horizontal, or deviated, or any other orientation.

Packers 26 straddle target zones of the formation. The packers 26 can isolate the target zones for stimulation and production and which may have fractures 35. The packers 26 may be swellable packers. The packers 26 can also be other types of packers as are known in the industry, for example, slip-type, expandable or inflatable packers. Additional downhole tools or devices may also be included on the work string, such as valve assemblies, for example safety valves, inflow control devices, check valves, etc., as are known in the art. The tubing sections between the packers 26 may include sand screens to prevent the intake of particulate from the formation as hydrocarbons are withdrawn. Various suitable sand screens include wire mesh, wire wrap screens, perforated or slotted pipe, perforated shrouds, porous metal membranes, or other screens which permit the flow of desirable fluids such as hydrocarbons and filter out and prevent entry of undesirable particulates such as sand.

As shown, an array of sensors 100 can be spoolable from spool 105. The array of sensors 100 is shown as having a line 110 which connect each of the individual sensors 101. The plurality of sensors 101 are disposed along the longitudinal length of the tubular string 22 in the wellbore 13. While illustrated as connected by line 110, the array of sensors 100 can also be coupled with the tubular string 22 without the line 110. Data from the array of sensors 101 may be transmitted along the line 110 and provided to one or more processors at the surface, such as device 200 discussed further below. In other examples, data from the array of sensors 101 can be transmitted wirelessly or through the tubular string 22 to surface and/or device 200.

The line 110 may be a cord, line, metal, tubing encased conductor (TEC), fiber optic, or other material or construction, and may be conductive and permit power and data to transfer over the line 110 between each of the sensors 101 and to the surface. The line 110 may be sufficiently ductile to permit spooling and some amount of bending, but also sufficiently rigid to hold a particular shape in the absence of external force.

A completion can be divided into production zones through the use of one or more packers 26. The production flow comes from the formation and may pass through a screen, through a flow regulator (inflow control device (ICD), autonomous inflow control device (AICD), inflow control valve (ICV), choke, nozzle, baffle, restrictor, tube, valve, et cetera), and into the interior of the tubing.

Figure 2:
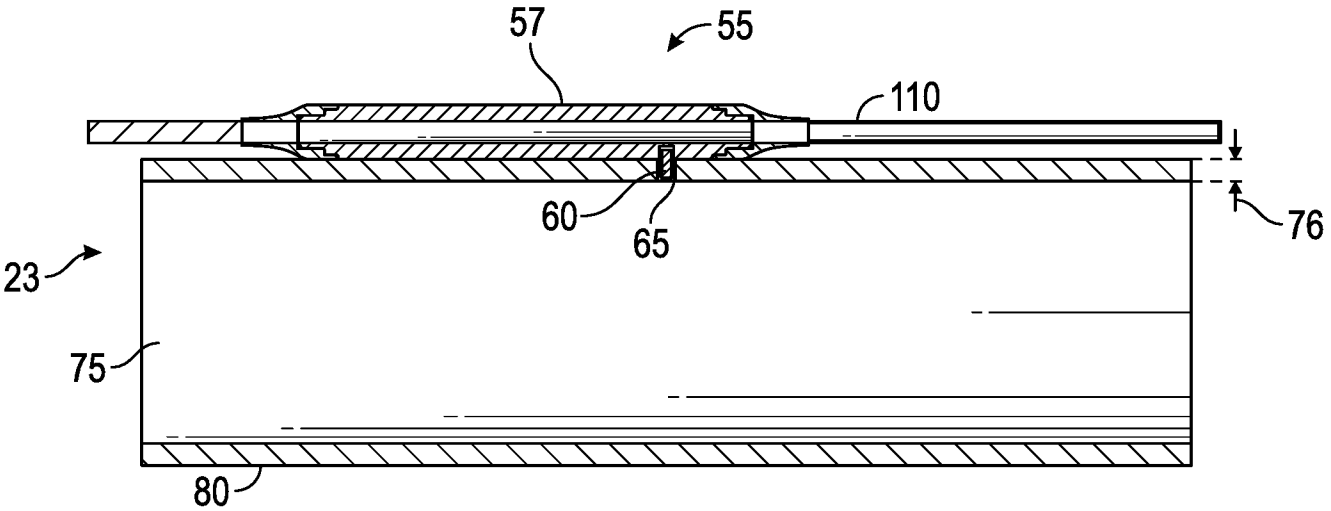
FIG. 2 is a schematic cross-sectional view of an example tubular string having a sensor nipple and corresponding port according to the disclosure herein.

FIG. 2 is a cross-sectional view of a tubular 23 of a tubular string 22 according to the present disclosure. The tubular string 22 can be made from one or more tubulars 23 coupled together forming a length of tubular string. The tubular 23 and tubular string 22 can have a central flow passage 75 formed therethrough. The tubular 23 can be coupled with one or more sensors from the array of sensors 100. A sensor 55 can be one sensor coupled with the senor array 100. The sensor 55 can be coupled with a nipple 60 inserted and received into sensor port 65 of the tubular 23.

The sensor 55 may be coupled with the line 110 which connects to other sensors in an array of sensors, such as array of sensors 100, in which the other sensors may be one or more sensors 55, other sensors, or any combination thereof. As shown the tubular 23 has a central flow passage 75 for flow of a fluid (such as, hydrocarbons, etc.) and an external surface 80. In order to monitor fluid properties (such as, temperature and pressure, etc.) within the tubular string 22 a nipple 60 can be coupled to each tubing sensor 55 within the array. The sensor 55 may have a main body 57 and have the nipple 60 extending therefrom. The nipple 60 may be elastomeric, plastic or metal. The nipple 60 can be welded or otherwise coupled with the sensor 55 depending on the arrangement of the nipple 60 and the engagement between the nipple 60 and the tubular 23. In at least one example, the nipple 60 and the tubular 23 can be a metal-to-metal engagement. In particular, the nipple 60 engages the tubular 23 via a corresponding sensor port 65 of tubular 23. The nipple 60 may be an extension or projection and shaped for entry into or otherwise coupling with the sensor port 65.

The sensor port 65, which may be a hole, aperture, notch, groove, indentation, or similar, can be created at any location on the tubing string, such as any location on any particular tubular 23 within the tubular string 22. The sensor port 65 may be made within an approximate location of the sensor 55 or any position or location where the sensor 55 may be. The sensor port 65 may be created by any method available (e.g. drilling, piercing, burning, pierce with attached nipple, etc.). In at least one example, the sensor port 65 can be created on-the-fly, such that a workman on-site can simply form the sensor port 65 and couple the sensor therein by insertion of the nipple 60 into the sensor port 65. The nipple 60 can be self-tapping arrangement for simultaneous formation of the sensor port 65 and coupling of the nipple 60 with the tubular 23. In other examples, the sensor port 65 can be a threaded aperture allowing threaded engagement between the sensor 55 and the tubular 23.

The sensor port 65 can extend from the external surface 80 toward the central flow passage 75 through a wall thickness 76 of the tubular 23. The sensor port 65 can extend through the wall thickness 76 sufficient for the sensor 55 and nipple 60 to measure one or more fluid properties of the fluid within the central flow passage 75. The sensor port 65 can extend through the wall thickness 76 sufficient for the nipple 60 to be in fluidic contact with the central flow passage 75, thus allowing one or more fluid property measurements.

The nipple 60 on the sensor 55 may be positioned inside the sensor port 65 and sealed by an elastomer, metal-to-metal, adhesive seal, or other sealing mechanism. The nipple 60 itself may provide a sealing. In at least one instance, the nipple 60 can be formed from an elastomeric element providing a seal upon coupling the nipple 60 with the sensor port 65. The sealing mechanism provided by between the nipple 60 and the sensor port 65 can prevent annulus fluid from entering the sensor port 65 and/or prevent fluid from exiting the central flow passage 75 and entering the annulus depending on the arrangement of the sensor port 65. In instances where the sensor port 65 extends through the wall thickness 76 of the tubular 23, the sealing mechanism can prevent fluid flow between the central flow passage 75 and annulus. In instances where the sensor port 65 extends through only a portion of the wall thickness 76, the sealing mechanism prevents fluid flow from the annulus into the sensor port 65.

Figure 3:
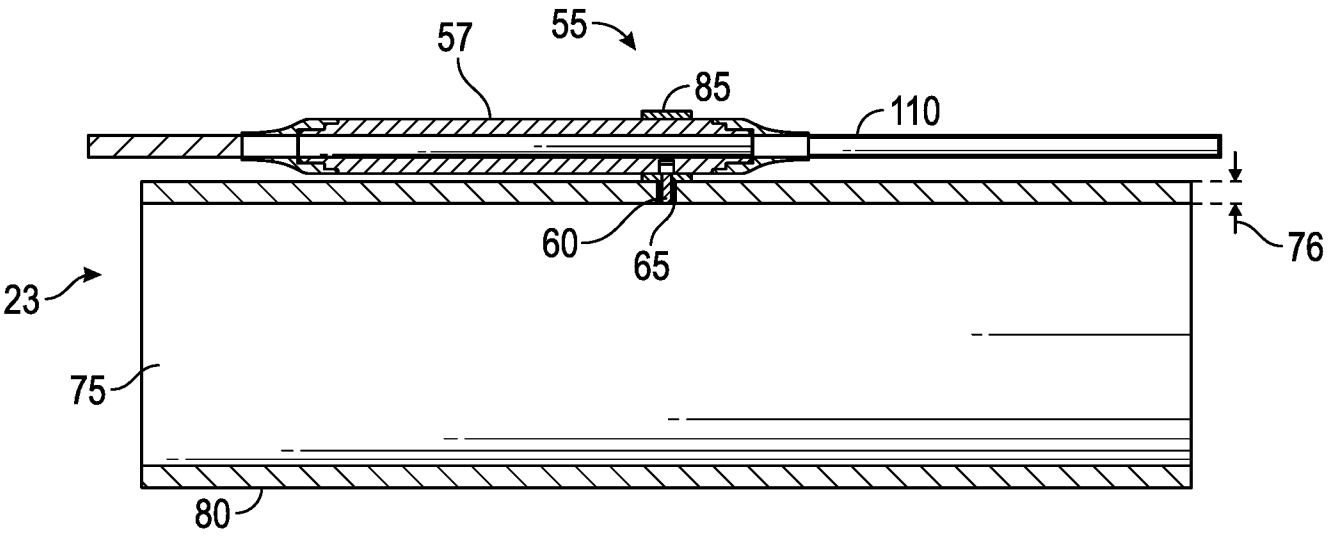
FIG. 3 is a schematic cross-sectional view of another example of a tubular string having a sensor nipple coupled via an connector or fitting according to the disclosure herein.

As illustrated in FIG. 3, a connector or fitting 85 may also be used for coupling the nipple 60 with the sensor port 65 of the tubular 23. In at least one instance, the connector or fitting 85 can be a clamp attached to securely hold the sensor 55, thereby reducing movement of the sensor 55 and nipple 60 relative to the tubular 23. The connector or fitting 85 can circumferentially extend around the tubular 23 to compress and/or secure the sensor 55 with the tubular 23. In some instances, alignment tolerances can be adjusted by including a full or semi-coil of the line 110 within the array providing slack and or reducing tension within line 110.

The array of sensors 100 disclosed herein can include sensors having the nipple, as disclosed in FIGS. 2-3, and conventional sensors without the nipple intermixed and coupled with the line 110. In at least one instance, the array of sensors 100 can alternate between sensors having a nipple and convention sensors. In other instances, the array of sensors 100 can have a predetermined ratio of sensors having a nipple to conventional sensors. The ratio of sensors can be distributed in a pattern, such as two convention sensors followed by one sensor with a nipple, and repeated along the length of the line 110. The ratio of sensors can also be distributed substantially randomly along the length of the line 110. While a predetermined ratio of two to one is described above, it is within the scope of this disclosure to have any ratio including, but not limited to, one to one, three to one, three to two, or any other combination, and the ratio can be defined as either conventional sensors to nipple sensors or nipple sensors to convention sensors. Accordingly, the array of sensors 100 of FIG. 1 may include a plurality of sensors as described according to FIGS. 2-3, as well as conventional sensors conventional sensors without a shroud and snorkel line, and may be arranged to alternate between the one and the other, any other combination or order along the line 110.

Moreover, although the sensors in FIGS. 1-3 are illustrated as coupled with a line (such as a TEC), the array of sensors may instead be simply coupled to the tubular or a collar without an intervening line between the sensors of the array.

Figure 4:
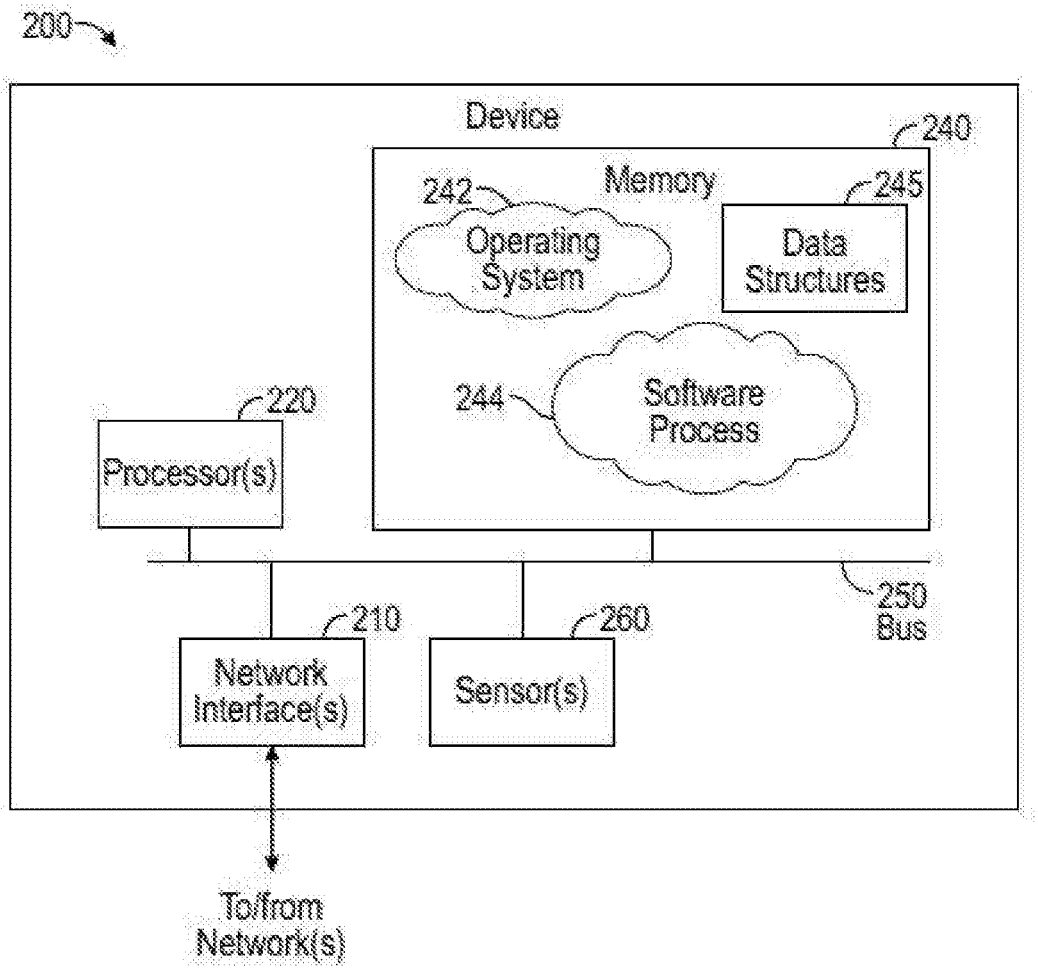
FIG. 4 is a schematic diagram of a processing device which may be employed with the disclosure herein.

FIG. 4 is a block diagram of an exemplary device 200. Device 200 is configured to perform processing of data and communicate with the sensors 101 of the array of sensors 100. In operation, device 200 communicates with one or more of the above-discussed borehole components and may also be configured to communication with remote devices/systems.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communication links, which may include wired or wireless communication links. Network interfaces 210 are configured to transmit and/or receive data using a variety of different communication protocols, as will be understood by those skilled in the art.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260, which may include the sensors 101 of the array of sensors 100 as disclosed herein, typically operate in conjunction with processor 220 to perform wellbore measurements, and can include special-purpose processors, detectors, transmitters, receivers, and the like. In this fashion, sensors 260 may include hardware/software for generating, transmitting, receiving, detection, logging, and/or sampling magnetic fields, seismic activity, and/or acoustic waves, or other well parameters.

Memory 240 comprises a plurality of storage locations that are addressable by processor 220 for storing software programs and data structures 245 associated with the embodiments described herein. An operating system 242, portions of which are typically resident in memory 240 and executed by processor 220, functionally organizes the device by, inter alia, invoking operations in support of software processes and/or services 244 executing on device 200. These software processes and/or services 244 may perform processing of data and communication with device 200, as described herein. Note that while process/service 244 is shown in centralized memory 240, some embodiments provide for these processes/services to be operated in a distributed computing network.

It will be apparent to those skilled in the art that other processor and memory types, including various computer-readable media, may be used to store and execute program instructions pertaining to the wellbore evaluation techniques described herein. Also, while the description illustrates various processes, it is expressly contemplated that various processes may be embodied as modules having portions of the process/service 244 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

Numerous examples are provided herein to enhance understanding of the present disclosure. A specific set of statements are provided as follows.

Statement 1: An array of sensors comprising: a plurality of communicatively coupled sensors disposed along a longitudinal length of a tubular string, the tubular string having a central flow passage therethrough and at least one of the plurality of sensors having a main body and a nipple extending from the main body, the nipple shaped for entry into a corresponding sensor port of a tubular of the tubular string, the nipple extending toward the central flow passage.

Statement 2: The array of sensors of Statement 1, wherein the at least one of the plurality of sensors having the nipple includes a seal about the nipple for a sealed coupling with the corresponding sensor port of the tubular.

Statement 3: The array of sensors of Statement 1 or Statement 2, wherein the at least of the plurality of sensors having the nipple is coupled with the tubular via a clamp or seal.

Statement 4: The array of sensors of any one of preceding Statements 1-3, wherein the plurality of sensors are connected, one to the other, via a conductive line.

Statement 5: The array of sensors of any one of preceding Statements 1-4, wherein the sensor port extends from an external surface of the tubular toward the central flow passage, the sensor port extending at least a portion of a wall thickness of the tubular.

Statement 6: The array of sensors of any one of preceding Statements 1-5, wherein the sensor port is in fluidic communication with the central flow passage.

Statement 7: A tubular string comprising a tubular having a central flow passage for an internal fluid and an external surface, the tubular having a wall thickness defined between external surface and the central flow passage, at least one sensor port disposed along a longitudinal length of the tubular, and at least one sensor having a main body and nipple extending from the main body and inserted into the sensor port of the tubular, extending through the wall thickness sufficient to detect a property of an internal fluid within the central flow passage Statement 8: The tubular string of Statement 7, wherein the sensor being one of an array of sensors extending along the longitudinal length of the tubular string Statement 9: The tubular string of Statements 7 or 8, wherein the sensor port is an indentation in the external surface of the tubular extending at least partially through the wall thickness Statement 10: The tubular string of any one of preceding Statements 7-9, wherein the sensor port is an aperture in the external surface external surface of the tubular extending through the wall thickness and into the central flow passage.

Statement 11: The tubular string of any one of preceding Statements 7-10, further comprising a seal disposed about the nipple and sensor port, thereby sealing the sensor port from fluid entry or exit.

Statement 12: The tubular string of any one of preceding Statements 7-11, wherein a fitting is provided about the sensor port for receiving the nipple.

Statement 13: The tubular string of any one of preceding Statements 7-12, wherein a clamp is provided about the sensor securing the sensor to the tubular.

Statement 14: The tubular string of any one of preceding Statements 7-13, wherein a second sensor of the array of sensors detects one or more property of a fluid in an annulus.

Statement 15: The tubular string of any one of preceding Statements 7-14, wherein the sensor detects detect a property of a fluid within the central flow passage and detects a property of a fluid in an annulus.

Statement 16: A method comprising deploying a tubular string within a wellbore, the tubular string having a central flow passage and an external surface, at least one tubular of the tubular string having a sensor port along a longitudinal length thereof, and deploying an array of sensors into the wellbore, at least one of the sensors having a main body and a nipple, the at least one sensor having a main body and nipple coupled with the sensor port of the at least one tubular, the nipple extending toward the central flow passage sufficient to detect a property of an internal fluid within the central flow passage.

Statement 17: The method of Statement 16, further comprising forming the sensor port on-the-fly by at least one of a piercing tool, drilling tool, or burning tool.

Statement 18: The method of Statement 16 or 17, further comprising forming the sensor port and coupling the nipple with the sensor port.

Statement 19: The method of any one of preceding Statements 16-18, further comprising simultaneously forming the sensor port and coupling the nipple with the sensor port.

Statement 20: The method of any one of preceding Statements 16-19, further comprising detecting a fluid property in an annulus of the wellbore adjacent the tubular having the at least one sensor with the nipple coupled with the sensor port of the tubular.

Statement 21: The method of any one of preceding Statements 16-20, wherein the array of sensors are connected via conductive line.

Statement 22: The method of any one of preceding Statements 16-21, wherein the sensor port is an indentation in the external surface of the tubular.

Statement 23: The method of any one of preceding Statements 16-21, wherein the sensor port is an aperture in the external surface of the tubular extending to the central flow passage.

Statement 24: The method of any one of preceding Statements 16-21, further comprising a seal disposed about the nipple and sensor port, thereby sealing the sensor port from fluid entry or exit.

Statement 25: The method of any one of preceding Statements 16-21, wherein a fitting is provided about the sensor port for receiving the nipple.

Statement 26: The method of any one of preceding Statements 16-21, further comprising securing the sensor to the tubular string via a clamp.

Statement 27: The method of any one of preceding Statements 16-21, further comprising receiving, by a processor outside of the wellbore, data relating to a property of the internal fluid within the central flow passage.

Statement 28: The method of any one of preceding Statements 16-21, wherein the property is at least one of a temperature, a pressure, or a flow rate of the internal fluid within the central flow passage.

Statement 29: A method comprising forming a sensor port along the length of a tubular, the tubular string having a central flow passage and an external surface, and inserting a nipple of a sensor into the sensor port of the tubular, the sensor having a main body and the nipple extending from the main body, the nipple inserted sufficient to detect a downhole property of an internal fluid within the central flow passage Statement 30: The method of Statement 29, further comprising deploying a tubular string within a wellbore having the tubular with the sensor inserted within the sensor port.

Statement 31: The method of Statements 29 or 30, wherein the sensor is inserted with the tubular into the wellbore as part of an array of sensors connected via a line.

Statement 32: The method of any one of preceding Statements 29-31, further comprising forming the sensor port on-the-fly.

Statement 33: The method of any one of preceding Statements 29-32, wherein the sensor port is formed with at least one of a piercing tool, drilling tool, or burning tool.

Statement 34: The method of any one of preceding Statements 29-33, further comprising coupling the sensor with the nipple.

Statement 35: The method of any one of preceding Statements 29-34, further comprising simultaneously forming the sensor port and inputting the nipple into the sensor port.

Statement 36: The method of any one of preceding Statements 29-35, further comprising detecting a fluid property in an annulus of the wellbore proximate the tubular having the sensor with the nipple inserted into the sensor port of the tubular.

Statement 37: The method of any one of preceding Statements 29-36, further comprising, receiving, by a processor outside of the wellbore, data regarding a downhole property of the fluid within the central flow passage.

Statement 38: The method of any one of preceding Statements 29-37, wherein the downhole property is at least one of temperature, pressure, or flow rate of the internal fluid within the central flow passage.

Statement 39: The method of any one of preceding Statements 29-38, further comprising determining a flow rate of the fluid within the central flow passage.

What is claimed is:

1. An array of sensors comprising:

a plurality of communicatively coupled sensors disposed along a longitudinal length of a tubular string, the tubular string having a central flow passage therethrough;

at least one of the plurality of sensors having a main body and a nipple extending from the main body, the nipple shaped for entry into a corresponding sensor port of a tubular of the tubular string, the nipple extending toward the central flow passage;

a seal disposed about the nipple and sensor port, thereby sealing the sensor port from fluid entry or exit; and wherein the nipple and the seal prevent annulus fluid from entering the sensor port or exiting to the central flow passage.

2. The array of sensors of claim 1, wherein the at least one of the plurality of sensors having the nipple includes a seal about the nipple for a sealed coupling with the corresponding sensor port of the tubular.

3. The array of sensors of claim 1, wherein the at least of the plurality of sensors having the nipple is coupled with the tubular via a clamp or seal.

4. The array of sensors of claim 1, wherein the plurality of sensors are connected, one to the other, via a conductive line.

5. The array of sensors of claim 1, wherein the sensor port extends from an external surface of the tubular toward the central flow passage, the sensor port extending at least a portion of a wall thickness of the tubular.

6. The array of sensors of claim 1, wherein the sensor port is in fluidic communication with the central flow passage.

7. A tubular string comprising:

a tubular having a central flow passage for an internal fluid and an external surface, the tubular having a wall thickness defined between external surface and the central flow passage;

at least one sensor port disposed along a longitudinal length of the tubular; and at least one sensor having a main body and nipple extending from the main body and inserted into the sensor port of the tubular, extending through the wall thickness sufficient to detect a property of an internal fluid within the central flow passage;

a seal disposed about the nipple and sensor port, thereby sealing the sensor port from fluid entry or exit; and wherein the nipple and the seal prevent annulus fluid from entering the sensor port or exiting to the central flow passage.

8. The tubular string of claim 7, the sensor being one of an array of sensors extending along the longitudinal length of the tubular string.

9. The tubular string of claim 7, wherein the sensor port is an indentation in the external surface of the tubular extending at least partially through the wall thickness.

10. The tubular string of claim 7, wherein the sensor port is an aperture in the external surface external surface of the tubular extending through the wall thickness and into the central flow passage.

11. The tubular string of claim 7, wherein a fitting is provided about the sensor port for receiving the nipple.

12. The tubular string of claim 7, wherein a clamp is provided about the sensor securing the sensor to the tubular.

13. The tubular string of claim 7, wherein a second sensor of the array of sensors detects one or more property of a fluid in an annulus.

14. The tubular string of claim 7, wherein the sensor detects a property of a fluid within the central flow passage and detects a property of a fluid in an annulus.

15. A method comprising:

deploying a tubular string within a wellbore, the tubular string having a central flow passage and an external surface, at least one tubular of the tubular string having a sensor port along a longitudinal length thereof;

deploying an array of sensors into the wellbore, at least one of the sensors having a main body and a nipple, the at least one sensor having a main body and nipple coupled with the sensor port of the at least one tubular, the nipple extending toward the central flow passage sufficient to detect a property of an internal fluid within the central flow passage; a seal disposed about the nipple and sensor port, thereby sealing the sensor port from fluid entry or exit wherein the nipple and the seal prevent annulus fluid from entering the sensor port or exiting to the central flow passage.

16. The method of claim 15, further comprising forming the sensor port on-the-fly by at least one of a piercing tool, drilling tool, or burning tool.

17. The method of claim 15, further comprising forming the sensor port and coupling the nipple with the sensor port.

18. The method of claim 15, further comprising simultaneously forming the sensor port and coupling the nipple with the sensor port.

19. The method of claim 15, further comprising detecting a fluid property in an annulus of the wellbore adjacent the tubular having the at least one sensor with the nipple coupled with the sensor port of the tubular.

20. The method of claim 15, wherein the array of sensors are connected via conductive line.

21. The method of claim 15, wherein the sensor port is an indentation in the external surface of the tubular.

22. The method of claim 15, wherein the sensor port is an aperture in the external surface of the tubular extending to the central flow passage.

23. The method of claim 15, further comprising a seal disposed about the nipple and sensor port, thereby sealing the sensor port from fluid entry or exit.

24. The method of claim 15, wherein a fitting is provided about the sensor port for receiving the nipple.

25. The method of claim 15, further comprising securing the sensor to the tubular string via a clamp.

26. The method of claim 15, further comprising receiving, by a processor outside of the wellbore, data relating to a property of the internal fluid within the central flow passage.

27. The method of claim 26, wherein the property is at least one of a temperature, a pressure, or a flow rate of the internal fluid within the central flow passage.

28. A method comprising:

forming a sensor port along the length of a tubular, the tubular having a central flow passage and an external surface;

inserting a nipple of a sensor into the sensor port of the tubular, the sensor having a main body and the nipple extending from the main body, a seal disposed about the nipple and sensor port, thereby sealing the sensor port from fluid entry or exit wherein the nipple and the seal prevent annulus fluid from entering the sensor port or exiting to the central flow passage, and the nipple inserted sufficient to detect a downhole property of an internal fluid within the central flow passage.

29. The method of claim 28, further comprising deploying a tubular string within a wellbore having the tubular with the sensor inserted within the sensor port.

30. The method of claim 29, wherein the sensor is inserted with the tubular into the wellbore as part of an array of sensors connected via a line.

31. The method of claim 28, further comprising forming the sensor port on-the-fly.

32. The method of claim 28, wherein the sensor port is formed with at least one of a piercing tool, drilling tool, or burning tool.

33. The method of claim 28, further comprising coupling the sensor with the nipple.

34. The method of claim 28, further comprising simultaneously forming the sensor port and inputting the nipple into the sensor port.

35. The method of claim 28, further comprising detecting a fluid property in an annulus of the wellbore proximate the tubular having the sensor with the nipple inserted into the sensor port of the tubular.

36. The method of claim 28, further comprising, receiving, by a processor outside of the wellbore, data regarding a downhole property of the fluid within the central flow passage.

37. The method of claim 36, wherein the downhole property is at least one of temperature, pressure, or flow rate of the internal fluid within the central flow passage.

38. The method of claim 36, further comprising determining a flow rate of the fluid within the central flow passage.

* * * * *